US010907103B2

(12) United States Patent
Reid et al.

(10) Patent No.: US 10,907,103 B2
(45) Date of Patent: Feb. 2, 2021

(54) BITUMEN EXTRACTION USING REDUCED SHEAR CONDITIONS

(71) Applicant: SYNCRUDE CANADA LTD. in trust for the owners of the Syncrude Project as such owners exist now and in the future, Fort McMurray (CA)

(72) Inventors: Kevin Reid, Edmonton (CA); Yin Ming Samson Ng, Sherwood Park (CA); Barry Bara, Edmonton (CA); Sujit Bhattacharya, Edmonton (CA)

(73) Assignee: SYNCRUDE CANADA LTD. in trust for the owners of the Syncrude Project as such owners exist now and in the future, Fort McMurray (CA)

( * ) Notice: Subject to any disclaimer, the term of this patent is extended or adjusted under 35 U.S.C. 154(b) by 0 days.

(21) Appl. No.: 16/378,301

(22) Filed: Apr. 8, 2019

(65) Prior Publication Data

US 2019/0309227 A1 Oct. 10, 2019

Related U.S. Application Data

(60) Provisional application No. 62/654,957, filed on Apr. 9, 2018.

(51) Int. Cl.
*C10G 1/04* (2006.01)
*C10G 1/00* (2006.01)

(52) U.S. Cl.
CPC ..... *C10G 1/045* (2013.01); *C10G 1/008* (2013.01); *C10G 2300/1003* (2013.01); *C10G 2300/1033* (2013.01)

(58) Field of Classification Search
CPC ..... C10G 1/008; C10G 1/045; C10G 2300/1003; C10G 2300/1033
See application file for complete search history.

(56) References Cited

U.S. PATENT DOCUMENTS 5,039,227 A 8/1991 Leung et al.
5,988,198 A 11/1999 Neiman et al.
(Continued)

FOREIGN PATENT DOCUMENTS

CA 2029795 A1 5/1991
CA 2870976 C 5/2015

OTHER PUBLICATIONS

Oil Sands Magazine, Technical Guide, Hydrotransport Pipelines: Basic Design Principles available at <https://www.oilsandsmagazine.com/technical/mining/hydrotransport/pipeline-design> (date unknown).*
(Continued)

*Primary Examiner* — Brian A McCaig
(74) *Attorney, Agent, or Firm* — Bennett Jones LLP

(57) ABSTRACT

A process for extracting bitumen from mined oil sand is provided, comprising: preparing an oil sand slurry comprising oil sand and water; conditioning the oil sand slurry by pumping the oil sand slurry through a hydrotransport pipeline under shear conditions that reduce the formation of water-in-bitumen emulsions in the conditioned oil sand slurry and increase the size of bitumen-air aggregates; and subjecting the conditioned oil sand slurry to gravity separation to produce a bitumen froth having enhanced bitumen recovery and reduced water-in-bitumen emulsions, a middlings layer and sand tailings.

5 Claims, 7 Drawing Sheets

(56) References Cited

U.S. PATENT DOCUMENTS

2010/0012555 A1* 1/2010 Moran ..... C10G 1/045 208/425
2016/0090536 A1* 3/2016 Yuan ..... C10G 1/047 208/390

OTHER PUBLICATIONS

E.C. Sanford, Processibility of Athabasca Tar Sand: Interrelationship Between Oil Sand Fine Solids, Process Aids, Mechanical Energy and Oil Sand Age after Mining, Can, J Chem. Eng,, 61 (1983) 554.
Masliyah, J., Czarnecki, J., 20 Xu, Zhenghe, "Handbook on Theory and Practice of Bitumen Recovery From Athabasca Oil Sands: vol. I: Theoretical Basis", Kingsley Publishing (2011) 281.
Sanders, S., Schaan, J., McKibben, M., "Oil Sand Slurry Conditioning Tests in a 100 mm Pipeline Loop", Can, J, Chem, Eng,, 85 (2007) 756.
Qiu, L., "Effect of Oil Sands Slurry Conditioning on Bitumen Recovery from Oil Sands Ores", MSc. Thesis, University of Alberta, (2010) 55.
Wallwork, V., Xu, Z., Masliyah, J., "Processability of Athabasca Oil Sand Using a Laboratory Hydrotransport Extraction System (LHES)", Can. J. Chem. Eng. 82 (2004) 689.
Gu, G., Sanders, S., Nandakumar, K., Xu, Z., Masliyah, J,, "A Novel Experimental Technique to Study Single Bubble-Bitumen Attachment in 20 Flotation", Int. J, Miner, Process 74 (2004) 21.
Zhou G. (1997) "Characteristics of Turbulence Energy Dissipation and Liquid-Liquid Dispersions in an Agitated Tank", Ph.D. Dissertation, Department of Chemical Engineering, University of Alberta.
Angle, Chandra & Dabros, Tadeusz & Hamza, Hassan. (2006). Predicting sizes of toluene-diluted heavy oil emulsions in turbulent flow. Part 1—Application of two adsorption kinetic models for σE in two size predictive models. Chemical Engineering Science. 61. 7309-7324.
Angle, Chandra & Hamza, Hassan. (2006). Predicting the sizes of toluene-diluted heavy oil emulsions in turbulent flow Part 2: Hinze—Kolmogorov based model adapted for increased oil fractions and energy dissipation in a stirred tank. Chemical Engineering Science. 61. 7325-7335.
Leng, Douglas E. and Richard V. Calabrese. "Immiscible Liquid—Liquid Systems." Handbook of Industrial Mixing: Science and Practice (2004).
Mussbacher, Scott L. "Effect of Energy Dissipation Rate on Bitumen Droplet Size." University of Alberta Department of Chemical and Materials Engineering, pp. 1-87 (Fall 2009).
Waldemar I. Friesen, Tadeusz Dabros, Teddy Kwon, A Bench—Scale Study of Conditioning Behavior in Oil Sands Slurries, The Canadian Journal of Chemical Engineering, 10.1002/cjce.5450820413, 82, 4, (743-751), (2008).
Waldemar I. Friesen, Tadeusz Dabros, Monte Carlo Simulation of Coalescence Processes in Oil Sands Slurries, The Canadian Journal of Chemical Engineering, 10.1002/cjce.5450820415, 82, 4, (763-775), (2008).
Calabrese, R.V. et al. (1986) "Drop Breakup in Turbulent Stirred-Tank Contractors Part 1: Effect of Dispersed-Phase Viscosity" AlChE J., 32, 657-666.

* cited by examiner

Figure 7A
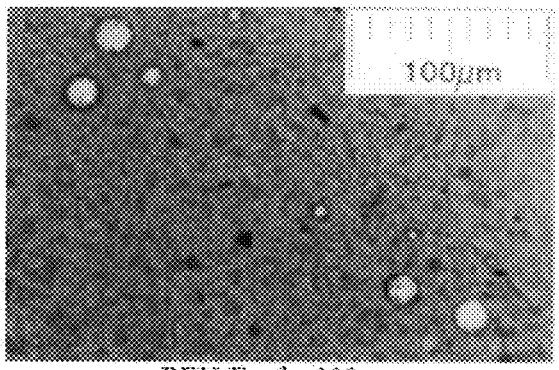
BEU Froth: 300 rpm
Figure 7B
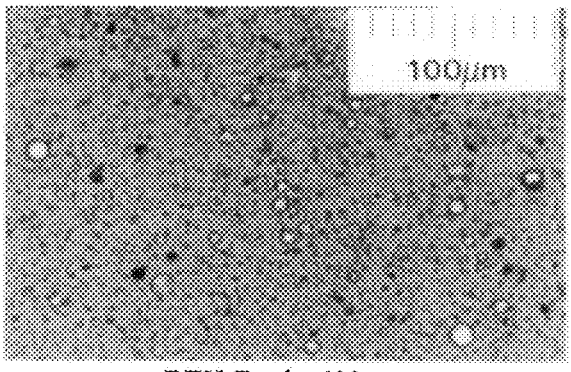
BEU Froth: 600 rpm
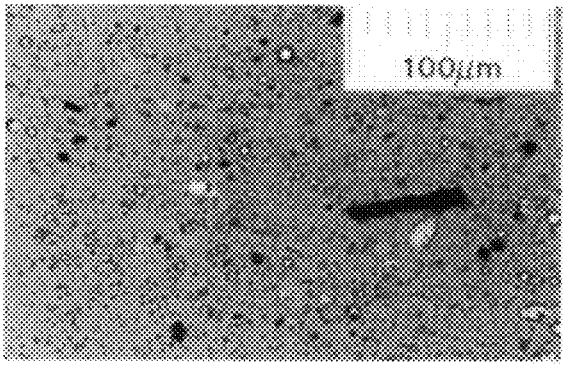
BEU Froth: 900 rpm
Figure 7C

BITUMEN EXTRACTION USING REDUCED SHEAR CONDITIONS

The present invention relates generally to a method for improving bitumen recovery and product quality (diluted bitumen) from mined oil sand. In particular, reduced shear conditions are used to increase bitumen-air aggregates size and to reduce water-in-oil emulsion formation in various bitumen streams, particularly, in the conditioned oil sand slurry stream, produced during water-based bitumen production.

BACKGROUND OF THE INVENTION

Oil sand, such as is mined in the Fort McMurray region of Alberta, generally comprises water-wet sand grains held together by a matrix of viscous bitumen. It lends itself to liberation of the sand grains from the bitumen by mixing or slurrying the oil sand in water, allowing the bitumen to move to the aqueous phase. Oil sand has a typical composition of 10 wt % bitumen, 5 wt % water and 85 wt % solids.

For many years, the bitumen in the McMurray oil sand has been commercially removed by mixing as-mined oil sand with heated water in a slurry preparation unit such as a rotary breaker, mix box, wet crushing assembly or a cyclofeeder to produce an oil sand slurry. Optionally, process aids such as caustic may also be added during oil sand slurry preparation. The oil sand slurry is then pumped through a pipeline at least about 2.5 kilometres in length, where oil sand slurry conditioning occurs. This conditioning process is referred to in the industry as hydrotransport. In some instances, a tumbler may also be used to prepare oil sand slurry, however, in this instance, conditioning occurs in the tumbler itself. Slurry conditioning comprises four (4) steps: oil sand lump ablation; bitumen liberation from sand grains; bitumen coalescence; and bitumen aeration.

During hydrotransport, lump ablation primarily occurs within the pipeline due to both thermal energy, which heats up oil sand lumps and reduces the bitumen viscosity, and mechanical energy, which strips layers from the heated oil sand lumps causing them to breakup. Bitumen is then liberated and released bitumen coalesce to form bitumen droplets. The bitumen droplets are then aerated, i.e., air bubbles attach to the bitumen droplets, to aid in bitumen flotation in the PSV. It is desirable to form large aerated bitumen droplets for enhanced flotation.

The resultant bitumen froth produced in the PSV typically comprises about 60 wt % bitumen, 30 wt % water and 10 wt % mineral solids. Hence, the froth must be further treated to reduce the water and solids content therein before upgrading in bitumen processing plants. A naphthenic froth treatment process is commonly used to produce a high quality diluted bitumen product which can then be sent to bitumen processing plants for further upgrading. Generally, bitumen froth is pumped through a pipeline to froth treatment plants. Unfortunately, however, currently the diluted bitumen product generally will still contain, on average, 2-5 wt % water and 0.5-1 wt % solids. The residual water in particular has highly deleterious effects in the downstream processing of bitumen.

Throughout the bitumen extraction process, various intermediate bitumen streams are pumped through the production line. Generally, in the industry, prior to the present invention, pumps were selected primarily based on head, capacity, weight and size, process control and price. However, it has been discovered by the present applicant that the use of high shear pumps results in smaller bitumen droplet size and the formation of water-in-oil emulsions, which may effect further downstream upgrading. Overall, formation of these emulsions interferes with the separation process.

SUMMARY OF THE INVENTION

The present invention is directed to the use of reduced shear conditions during bitumen extraction from mined oil sand. In particular, it has been discovered by the present applicant that when various bitumen streams are pumped in the production line, the streams are subjected to shear forces through pumps which free water in the bitumen streams, thereby causing water-in-oil emulsions. It was discovered that the higher the shear force, the smaller the droplets of the dispersed phase and, hence, the more stable the emulsion. The stability of the emulsion determines how long it takes to separate the phases.

In addition, it was discovered by the present applicant that bitumen recovery is enhanced when reduced shear pumping conditions are used, which promotes larger bitumen-air aggregates.

Thus, in one aspect, the present invention is directed to a process for extracting bitumen from mined oil sand, comprising:

- preparing an oil sand slurry comprising oil sand and water;
- conditioning the oil sand slurry by pumping the oil sand slurry through a hydrotransport pipeline under shear conditions that reduce the formation of water-in-bitumen emulsions in the conditioned oil sand slurry and increase the size of bitumen-air aggregates; and
- subjecting the conditioned oil sand slurry to gravity separation to produce a bitumen froth having enhanced bitumen recovery and reduced water-in-bitumen emulsions, a middlings layer and sand tailings.

In one embodiment, the process further comprises:

- treating the bitumen froth having enhanced bitumen recovery and reduced water-in-bitumen emulsions with a diluent to produce a diluted bitumen product having reduced solids and/or reduced water.

In one embodiment, the process further comprises:

- pumping the bitumen froth through a pipeline to a froth treatment plant under shear conditions that reduce formation of further water-in-bitumen emulsions to produce a diluted bitumen product having further reduced water-in-bitumen emulsions.

In another aspect, the present invention is directed to a process for conditioning an oil sand slurry, comprising:

- determining an energy dissipation rate necessary for obtaining a desired bitumen droplet size;
- designing a hydrotransport pipeline comprising pipe and at least one slurry pump by determining a diameter of pipe and/or a volume of the at least one slurry pump necessary to achieve the energy dissipation rate;
- conditioning the oil sand slurry in the so designed hydrotransport pipeline; and
- introducing the conditioned oil sand slurry into a primary separation vessel wherein separate layers of primary bitumen froth, middlings and sand tailings are formed.

In one embodiment, where droplet breakup dominates over droplet coalescence, the energy dissipation rate can be estimated by using the equation $$d\max = K\varepsilon^{-n} \quad (1)$$

where $d_{max}$=maximum droplet diameter, m

K=constant value n=constant value ranging between about 0.137 to 0.25, depending on the particular oil sand slurry ε=energy dissipation rate per unit mass, m2/s3 or W/kg.

The mean energy dissipation rate per unit mass, ε, is the parameter that describes the intensity of the turbulence. Thus, in order to reduce shear forces and the droplet break-up of the dispersed phase, the mean energy dissipation rate must be minimized according to Equation 1.

Other features will become apparent from the following detailed description. It should be understood, however, that the detailed description and the specific embodiments, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIGS. 7A, 7B and 7C are micrographs showing water droplet sizes in bitumen froth formed in a mixer with impeller speeds of 300 rpm, 600 rpm and 900 rpm, respectively.

DESCRIPTION OF THE PREFERRED EMBODIMENT

Figure 1:
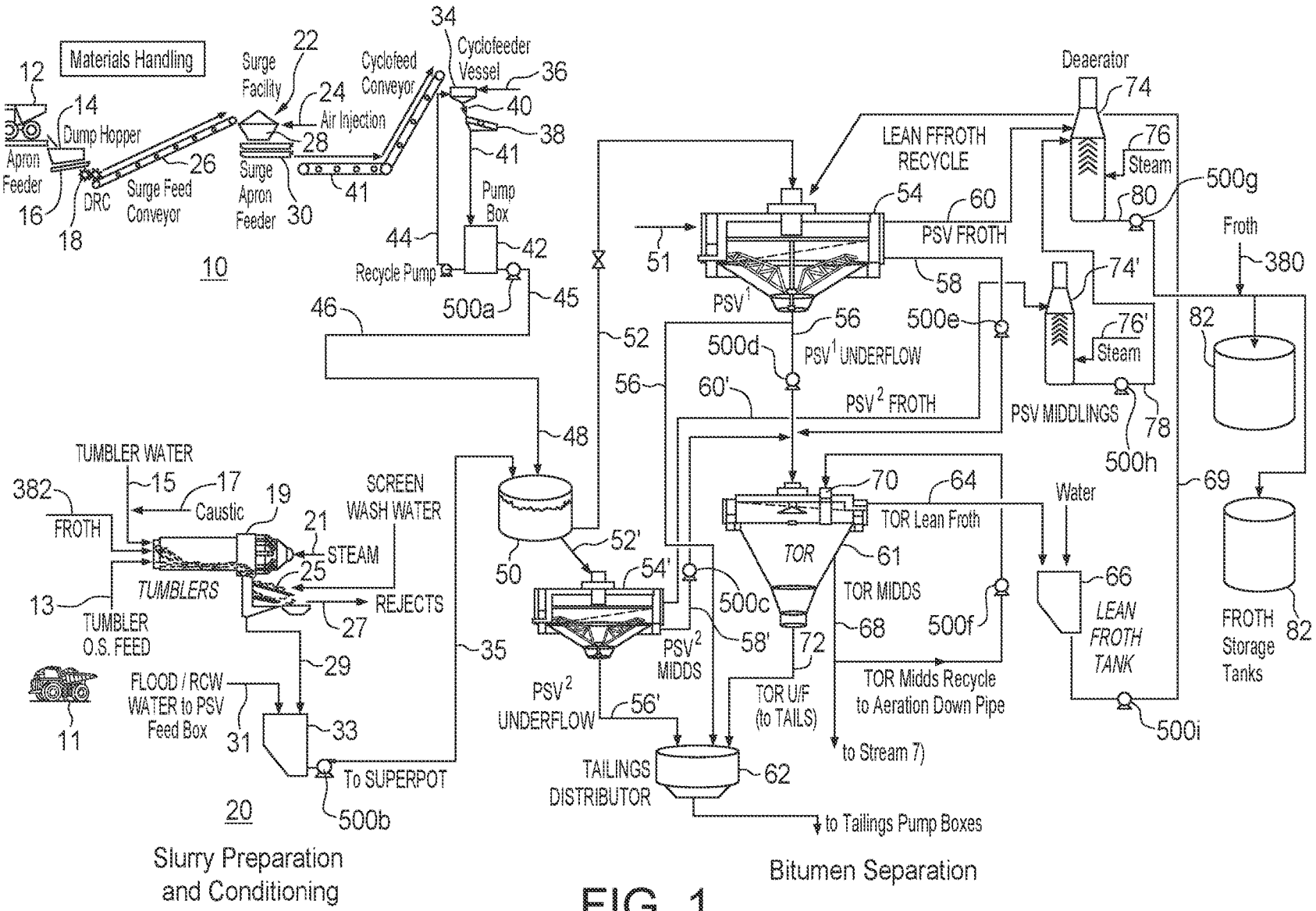
FIG. 1 is a schematic of two different slurry preparation and conditioning process trains having a common bitumen separation plant.

The invention is exemplified by the following description and examples. As used herein, "oil sand slurry" refers to a mined oil sand ore and water slurry produced in a slurry preparation unit such as a tumbler, rotary breaker, mix box, wet crushing assembly or a cyclofeeder to produce an oil sand slurry. Generally, an oil sand slurry has a composition of about 5-8 wt % bitumen and about 55-65 wt % solids and still contains oil sand lumps. Generally, oil sand slurry is subjected to further treatment called conditioning when using a slurry preparation unit other than a tumbler.

As used herein, "conditioning" means the treatment of an oil sand slurry such that oil sand lump ablation, bitumen liberation from sand grains, bitumen coalescence, and bitumen aeration, occurs. Conditioning may occur in a hydrotransport pipeline. As used herein, "bitumen droplet" refers to both non-aerated and aerated bitumen droplets. As used herein, "hydrotransport pipeline" refers to a hydrotransport pump/pipeline system which is designed to provide about a 20 minute residence time for the oil sand slurry for conditioning to occur in a standard commercial size pipeline (24-30 inch). To maintain residence time, when larger diameter pipes are used, the pipeline can be shortened by a factor equal to the area ratio change of the pipeline, e.g., when changing to a 34" diameter pipe, the pipeline would be shortened by $(34''/30'')^2$, which is equal to 1.28.

Bitumen droplet coalescence is more accurately defined as bitumen droplet breakup/coalescence. Bitumen droplets are continuously coalescing and breaking up as the oil sand slurry is subjected to hydrotransport in a hydrotransport pipeline. Two bitumen droplets can only coalesce after they are brought into contact with one another and it is the shear within the flow of the oil sand slurry that brings the droplets into contact. This would indicate that increasing the shear would result in ever larger droplets; however, this is not the case since shear can also cause droplets to break-up into smaller daughter fragments. Thus, the equilibrium droplet size is a balance between breakup and coalescence.

Prior to the present invention, it was commonly believed in the industry that a high energy dissipation rate (e.g., a high velocity/shear slurry system) was necessary for good slurry conditioning (see, for example, E. C. Sanford, Processibility of Athabasca Tar Sand: Interrelationship Between Oil Sand Fine Solids, Process Aids, Mechanical Energy and Oil Sand Age after Mining, Can, J Chem. Eng., 61 (1983) 554). The rationale for using high velocity/shear systems was related to improved ablation (see, for example, Masliyah, J., Czarnecki, J., Xu, Zhenghe, "Handbook on Theory and Practice of Bitumen Recovery From Athabasca Oil Sands: Volume I: Theoretical Basis", Kingsley Publishing (2011) 281), improved bitumen liberation (see, for example, Sanders, S., Schaan, J., McKibben, M., "Oil Sand Slurry Conditioning Tests in a 100 mm Pipeline Loop", Can. J. Chem. Eng., 85 (2007) 756) and improved aeration (see, for example, Qiu, L., "Effect of Oil Sands Slurry Conditioning on Bitumen Recovery from Oil Sands Ores", MSc. Thesis, University of Alberta, (2010) 55). These studies do not directly quantify the impact of high velocity/shear on bitumen droplet coalescence/breakup and the consequent bubble size.

It was discovered by the present applicant that there is an optimum mechanical energy dissipation rate for oil sand conditioning. Adequate mechanical agitation is required to liberate bitumen from sand grains and to generate small air bubbles for aeration, but this shear cannot be too high as this will cause break-up of aerated bitumen droplets. It is desirable to have larger bitumen droplets form for optimum bitumen recovery.

Furthermore, it was discovered by the present applicant that pumping bitumen froth at a high energy dissipation rate also caused the formation of froth dispersed water (water-in-oil emulsion), which resulted in more water (and solids) remaining in the hydrocarbon product (diluted bitumen product) after froth treatment.

It is now believed that coalescence and breakup, as well as the formation of water-in-oil emulsions, is dependent upon energy dissipation (ε=Watts/kg). Thus, to lower the energy dissipation within the slurry system, it is proposed to use larger slurry pumps and larger diameter pipe within the hydrotransport pipeline, which results in a lower pressure drop. However, it was uncertain whether switching to larger diameter pipes would have a negative effect on lump ablation, bitumen liberation and bitumen aeration. Surprisingly, however, it was discovered that increasing the pipe diameter actually resulted in better lump ablation or digestion. Without being bound to theory, it is believed that the increase in residence time in larger diameter pipelines actually aids in lump digestion. Thus, the increase in thermal energy actually counteracts the decrease in pipeline velocity.

It was further surprisingly discovered that using larger diameter slurry pumps (e.g., slurry pumps having twice the volume of a conventional pump such as a standard GIW TBC57.5 pump) at the same energy input as used when operating conventional slurry pumps also resulted in reduced energy dissipation. Thus, larger diameter slurry pumps also resulted in a significant increase in bitumen droplet size as compared to conventional slurry pumps.

It was also discovered that the use of a larger diameter pipeline and/or larger diameter slurry pumps to condition an oil sand slurry resulted in a decrease in the formation of micron (e.g., mean droplet size in the range of 4-6 microns) and sub-micron (e.g., mean droplet sizes in the range of 0.1-0.3 microns) droplets of water forming in the bitumen droplets (i.e., water-in-bitumen emulsions). Without being bound to theory, it is believed that the reduction of water-in-bitumen emulsions is due to the provision of a lower or reduced shear environment as a result of the reduced energy dissipation when using a larger diameter pipeline and/or larger diameter slurry pumps to condition an oil sand slurry. Slurry pumps useful in the present invention can include centrifugal pumps having large impeller diameter. However, it is understood that any pump having low shear characteristics can be used.

It was further surprisingly discovered that using reduced shear conditions to pump bitumen froth through a pipeline to a froth treatment plant also resulted in a decrease of froth dispersed water (water-in-bitumen emulsions). Once again, reducing high shear conditions may be accomplished by using larger diameter pumps and larger diameter pipe. Further, progressive cavity pumps can be used, which pumps generally show the least droplet shear. However, it is understood that any pump having low shear characteristics can be used.

A schematic of two different slurry preparation and conditioning process trains, train 10 and train 20, that may be operating at two different mine sites, is shown in FIG. 1. Train 10 depicts a slurry preparation and conditioning process that uses hydrotransport to condition oil sand slurry. Train 20 depicts a slurry preparation and conditioning process where oil sand slurry is conditioned in a tumbler. The conditioned oil sand slurries produced at each site are combined, allowing bitumen separation to occur at a single bitumen extraction plant, as will be described in more detail below.

Train 10 comprises mined oil sand being delivered by trucks 12 to a hopper 14 having an apron feeder 16 there below for feeding mined oil sand to a double roll crusher 18 to produce pre-crushed oil sand. Surge feed conveyor 26 delivers pre-crushed oil sand to surge facility 22 comprising surge bin 28 and surge apron feeders 30 there below. Air 24 is injected into surge bin 28 to prevent the oil sand from plugging.

The surge apron feeders 30 feed the pre-crushed oil sand to cyclofeeder conveyer 32, which, in turn, delivers the oil sand to cyclofeeder vessel 34 where the oil sand and water 36 are mixed to form oil sand slurry 40. Oil sand slurry 40 is then screened in screen 38 and screened oil sand slurry 41 is transferred to pump box 42. The cyclofeeder system is described in U.S. Pat. No. 5,039,227. Optionally, oversize lumps from screens 38 are sent to secondary reprocessing (not shown). Oil sand slurry 45 is then conditioned by pumping the slurry through a hydrotransport pipeline 46, from which conditioned oil sand slurry 48 is delivered to slurry distribution vessel 50 (also referred to herein as "superpot"). A portion of oil sand slurry 44 can be recycled back to cyclofeeder 34.

Train 20 comprises tumbler oil sand feed 13 being delivered by truck 11 and fed into tumbler 19. Tumbler hot water 15, caustic 17 (e.g., sodium hydroxide) and steam 21 are also added to tumbler 19 where the oil sand is mixed with the water to form a conditioned oil sand slurry. Residence time of the slurry in the tumbler is generally around 2.0 to 4.0 minutes. The slurry is then screened through reject screens 25 and rejects 27 are discarded. Screened conditioned oil sand slurry 29 is then transferred to a pumpbox 33 where additional water 31 may be added. The slurry 35 is then pumped to slurry distribution vessel 50.

Distribution vessel 50 is designed to mix the incoming flows, slurry 48 and slurry 35, to give a homogeneous slurry for further distribution. In one embodiment, slurry distribution vessel 50 is a passive vessel, meaning that no impellers are used. Hence, at this point, trains 10 and 20 are unified and a homogeneous slurry is formed so that bitumen separation can take place at a common bitumen separation plant to produce a more consistent quality of bitumen froth.

In one embodiment, the bitumen separation plant comprises at least one primary separation vessel, or "PSV". A PSV is generally a large, conical-bottomed, cylindrical vessel. In the embodiment shown in FIG. 1, slurry is distributed by the slurry distribution vessel 50 to two PSVs 54, 54' via slurry streams 52, 52'. The slurry 52, 52' is retained in the PSV 54, 54' under quiescent conditions for a prescribed retention period. During this period, the aerated bitumen rises and forms a froth layer, which overflows the top lip of the vessel and is conveyed away in a launder to produce bitumen froth 60, 60'. The sand grains sink and are concentrated in the conical bottom—they leave the bottom of the vessel as a wet tailings stream 56, 56'. Middlings 58, 58', a mixture containing fine solids and bitumen, extend between the froth and sand layers.

Some or all of tailings stream 56 and middlings 58, 58' are withdrawn, combined and sent to a secondary flotation process carried out in a deep cone vessel 61 wherein air is sparged into the vessel to assist with flotation of remaining bitumen. This vessel is commonly referred to as a tailings oil recovery vessel, or TOR vessel. The lean bitumen froth 64 recovered from the TOR vessel 61 is stored in a lean froth tank 66 and the lean bitumen froth 64 may be recycled to the PSV feed. The TOR middlings 68 may be recycled to the TOR vessel 61 through at least one aeration down pipe 70. TOR underflow 72 is deposited into tailings distributor 62, together with tailings streams 56, 56' from PSVs 54 and 54', respectively. It is understood, however, that other bitumen separation processes can be used in the present invention to unify separate mining sites. It is also understood that a bitumen separation process can be comprised of multiple pieces of equipment, for example, multiple primary separation vessels, multiple tailings oil recovery vessels and/or multiple secondary flotation units.

PSV 54 bitumen froth 60 is then deaerated in steam deaerator 74 where steam 76 is added to remove air present in the bitumen froth. Similarly, PSV 54' bitumen froth 60' is deaerated in steam deaerator 74' where steam 76' is added. Deaerated bitumen froth 78 from steam deaerator 74' is added to steam deaerator 74 and a final deaerated bitumen froth product 80 is stored in at least one froth storage tank 82 for further treatment. A typical deaerated bitumen froth comprises about 60 wt % bitumen, 30 wt % water and 10 wt % solids.

It was discovered by the present applicant that the locations where water-in-oil emulsions most commonly occur is where pumps 500*a* to 500*i* are located. Thus, in the present invention, pumps 500*a* to 500*i* are low shear pumps, which pump the various intermediate bitumen streams to the next-in-line step in the overall bitumen extraction process while reducing the formation of water-in-oil emulsions. Any pump which results in reduced energy dissipation can be used. For example, larger diameter slurry pumps (e.g., slurry pumps having twice the volume of a conventional pump such as a standard TBC57.5 pump) can be used at the same energy input as used when operating conventional slurry pumps.

Figure 2:
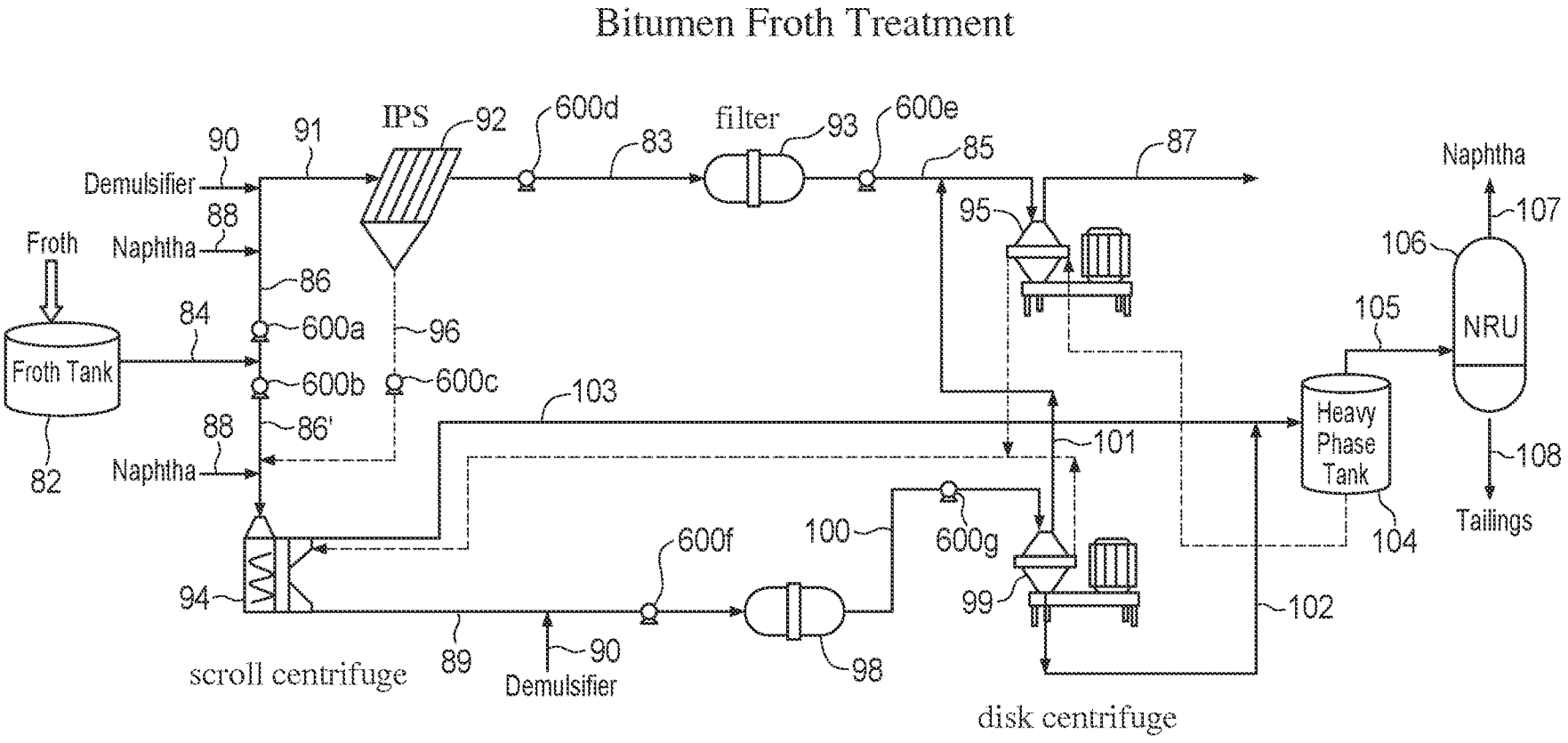
FIG. 2 is a schematic of a bitumen froth treatment plant.

Low shear pumps can also be used in bitumen froth treatment, where water-in-oil emulsions have been observed by the present applicant. A naphthenic froth treatment process is shown in FIG. 2. Bitumen froth 84 stored in froth tank 82 can be split into two separate streams, streams 86, 86'. Bitumen froth stream 86 is pumped from froth tank 82 and naphtha 88, generally at a diluent/bitumen ratio (wt./wt.) of about 0.4-1.0, preferably, around 0.7, and a demulsifier 90 are added to bitumen froth stream 86 to form a diluted froth stream 91. Diluted froth stream 91 is then subjected to separation in an inclined plate settler 92 (IPS). The IPS 92 acts like a scalping unit to produce an overflow 83 of diluted bitumen and an underflow 96 comprising water, solids and residual bitumen.

Overflow 83 is then pumped to filter 93, such as a Cuno filter, to remove oversize debris still present in the diluted bitumen 83. Filtered diluted bitumen 85 is then pumped and further treated in a disc centrifuge 95, which separates the diluted bitumen from the residual water (and fine clays) still present. A disc machine separates the hydrocarbon from the water in a rotating bowl operating with continuous discharge at a very high rotational speed. Sufficient centrifugal force is generated to separate small water droplets, of particle sizes as small as 2 μm to 5 μm, from the diluted bitumen.

The final diluted bitumen product 87 typically comprises between about 0.5 to 0.8 wt. % solids and 2.0-5.0 wt. % water and bitumen recovery is about 98.5%.

Deaerated bitumen froth stream 86' is also pumped from froth tank 82 where it is treated with naphtha at a diluent/bitumen ratio (wt./wt.) of about 0.4-1.0, preferably, around 0.7. The underflow 96 from IPS 92 can be pumped and added to stream 86' in order to recover any residual bitumen present in this underflow stream. The diluted bitumen froth is then treated in a decanter (scroll) centrifuge 94 to remove coarse solids from naphtha diluted froth. Decanter centrifuges are horizontal machines characterized by a rotating bowl and an internal scroll that operates at a small differential speed relative to the bowl. Naphtha-diluted froth containing solids is introduced into the centre of the machine through a feed pipe. Centrifugal action forces the higher-density solids towards the periphery of the bowl and the conveyer moves the solids to discharge ports.

The solids 103 are then fed to a heavy phase tank 104. The diluted bitumen 89 is further treated with a demulsifier 90, pumped to filter 98 and the filtered diluted bitumen 100 is then pumped to disc centrifuge 99 for further treatment. The resultant diluted bitumen 101 is then treated, along with filtered diluted bitumen stream 85, in disc centrifuge 95 which separates the diluted bitumen from the residual water (and fine clays) still present to give final diluted bitumen stream 87 (diluted bitumen product). The solids 102 are also fed to heavy phase tank 104. The solids 105 are then treated in a naphtha recovery unit 106 where naphtha 107 is separated from the froth treatment tailings 108.

At the points of highest incidents of water-in-oil emulsions, low shear pumps 600*a* to 600*g* are used. Use of low shear pumps 600*a* to 600*g* results in a final diluted bitumen stream that has both reduced water and solids content.

Figure 3:
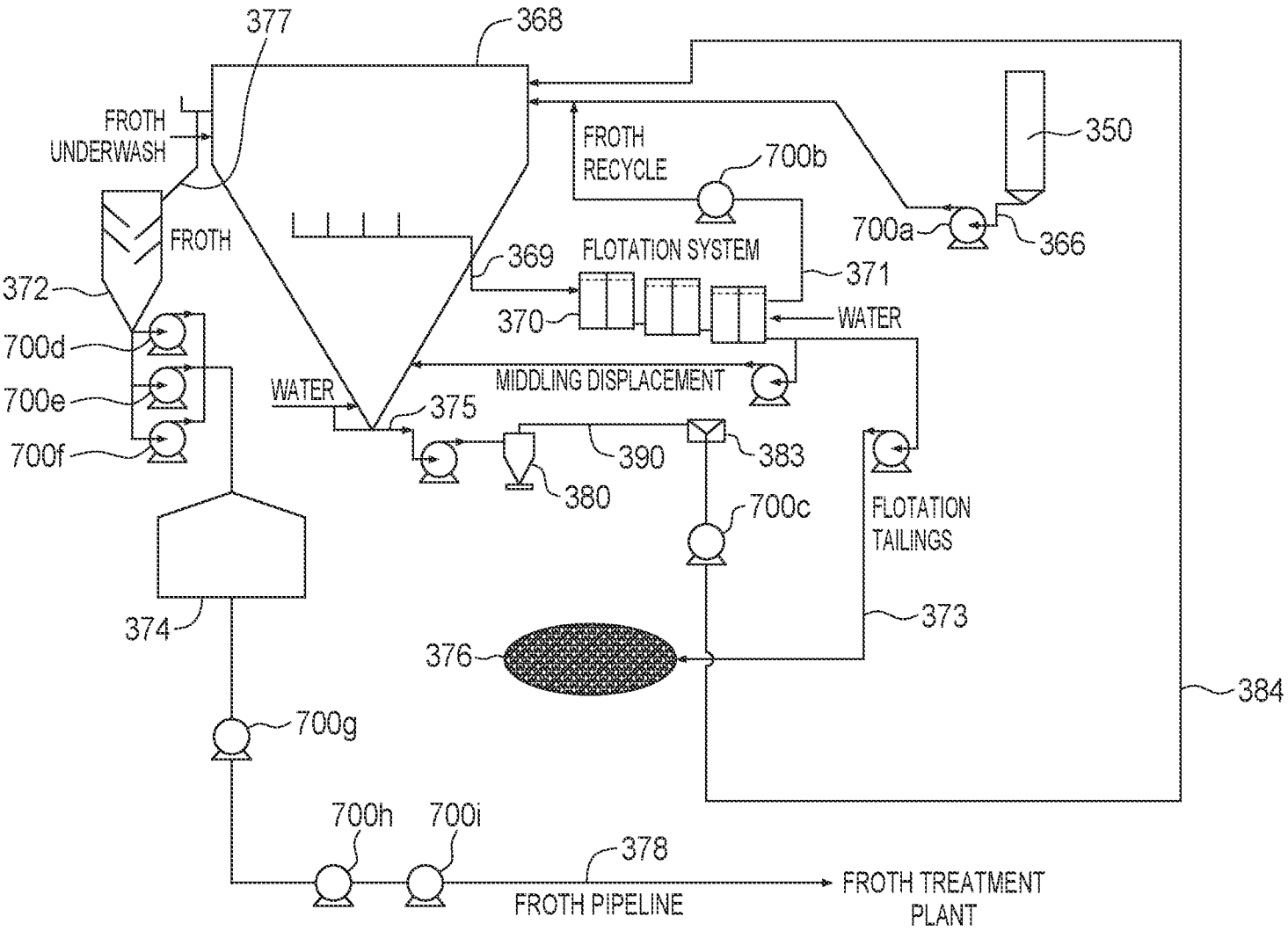
FIG. 3 is a schematic of bitumen stream recycling.

Low shear pumps can also be used when recycling bitumen streams to the primary separation vessel. Bitumen stream recycling is shown in FIG. 3. Conditioned oil sand slurry 366 is pumped via low shear pump 700*a* from slurry distributor 350 into primary separation vessel (PSV) 368 and retained under quiescent conditions, to allow the solids to settle and the bitumen froth to float to the top. A froth underwash of hot water is added directly beneath the layer of bitumen froth to aid in heating the froth and improving froth quality.

A bitumen froth layer, a middlings layer and a solids layer are formed in the primary separation vessel 368. Middlings 369 from primary separation vessel 368 are removed and undergo flotation in flotation cells 370 to produce secondary froth 371. Secondary froth 371 is recycled back to the primary separation vessel 368 using low shear pump 700*b*. Flotation tailings 373 are removed and deposited into tailings pond 376.

Tailings 375 are removed from the bottom of PSV 368 and can be used to make composite tailings for disposal. The PSV tailings 375 are first subjected to separation in a hydrocyclone 380, where the solids underflow is mixed with sand and gypsum to form composite tailings (not shown). The overflow 390, which contains residual bitumen, is then subjected to froth flotation in flotation cell 382. The froth 384 is then pumped using a low shear pump 700*c* and recycled back to PSV 368.

Bitumen froth 377, or primary froth, is removed from the top of the primary separation vessel 368 and then deaerated in froth deaerator 372. Once deaerated, the primary froth is pumped via low shear pumps 700*d*, 700*e*, 700*f* to froth tank 374. The deaerated bitumen froth stored in froth tank 374 can then be pumped using low shear pumps 700*g*, 700*h*, 700*i* via froth pipeline 378 to a froth treatment plant. Because the deaerated bitumen froth contains about 20 to 40% by volume water and the water contains colloidal-size particles such as clay, deaerated bitumen froth can be transported for long distances through froth pipeline 378 by establishing self-lubricated core-annular flow. Water can be added to promote the transport of froth in the pipeline if insufficient water is present in the deaerated froth. Core-annular flow is described in more detail in U.S. Pat. No. 5,988,198.

EXAMPLE 1

A comparison was done of the bitumen droplet size resulting from various conditioning technologies that are each operated with different levels of shear (energy dissipation). From lowest to highest shear (energy dissipation rate), a tumbler, a mixing tank with impellers, a 30 inch diameter hydrotransport pipeline and a jet pump were compared. Bitumen droplet size were measured from scaled video recording frames. Table 1 summarizes the bitumen droplet size and energy dissipation rate for each conditioning technologies.

TABLE 1

| Extraction System | Average Droplet Size, d | Energy Dissipation Rate, ε |
|---|---|---|
| Tumbler | 650 μm | 5 W/kg |
| Mixing Tank (impeller) | 300 μm | 50 W/kg |
| Hydrotransport (Pump) | 250 μm | 300 W/kg (pump) |
| | | 1 W/kg (pipeline) |
| Jet Pump | 150 μm | 5000 W/kg |

Figure 4:
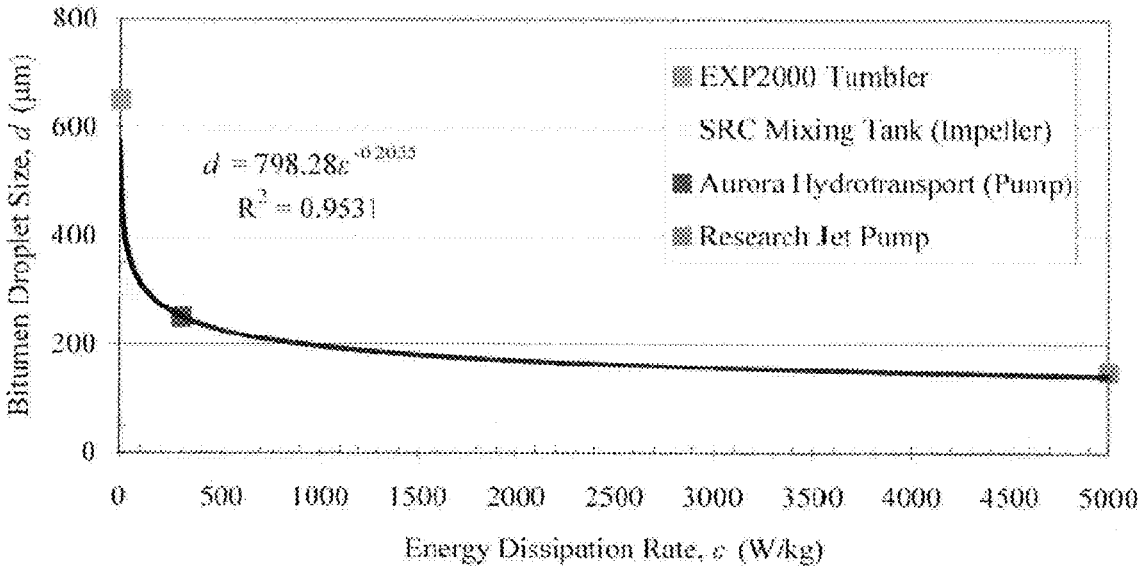
FIG. 4 is a graph showing bitumen droplet size (in microns) as a function of energy dissipation rate (W/kg) for various conditioning processes for conditioning oil sand slurry.

FIG. 4 shows the relationship between the bitumen droplet size and energy dissipation rate with a best-fit curve through the data points. It can be seen from FIG. 4 that the maximum stable droplet size increased exponentially with reduced energy dissipation. As the conditioning equipment became more vigorous in its agitation or high energy dissipation rate there is a significant decrease in bitumen droplet size. From the curve in FIG. 4, one can determine the constants K and n from Equation (1). This data can be used to estimate the effect of increased diameter pipes and pumps on bitumen droplet size.

In this embodiment, the energy dissipation rate is determined by using the equation:

$$d_{avg}=798\varepsilon^{-0.2035} \quad (2)$$

where $d_{avg}$=the average droplet diameter, m

ε=energy dissipation rate per unit mass, m2/s3 or W/kg.

In this example, n and K (of Equation (1)) were calculated to be 0.2035 and 798 respectively. The mean energy dissipation rate per unit mass, ε, is the parameter that describes the intensity of the turbulence. Thus, in order to reduce shear forces and the droplet break-up of the dispersed phase, the mean energy dissipation rate must be minimized according to Equation 2. Note that the exponent on the dissipation for a typical non-coalescing system was −0.25 while the commercial oil sand system outlined above had a coefficient of −0.20.

For any given pump, the energy required by the pump will be governed by the resistance in the pipeline. Thus, increasing the pipe diameter will decrease the pipe resistance and lead to reduced energy dissipation within the pump. A commercially operated hydrotransport pipeline used by the present applicant comprises 30 inch diameter pipe. Thus, at typical hydrotransport pipeline conditions, the 30 inch pipeline will have a pressure drop per unit length of approximately 322 Pa/m. However, if the 30 inch pipeline were replaced with a 34 inch pipeline, the 34 inch pipeline will operate at approximately 262 Pa/m. Thus, the pump energy dissipation values of 30 inch pipeline and the 34 inch pipeline would be approximately 539 W/kg and approximately 439 W/kg, respectively. This larger pipe may operate with a sliding/stationary deposit as outlined in Canadian Patent CA 2,870,976.

Using the relationship shown in FIG. 4, the 30 inch pipeline would have an average bitumen droplet size of 222 microns while the 34 inch pipeline would have an average bitumen droplet size of 231 microns. This is an approximate 4% increase in bitumen droplet diameter, but since terminal velocity is dependent upon diameter squared this is actually an approximate 8% increase in bitumen rise velocity.

The above example outlines the effect of increasing pipe diameter for a given pump. However, it was further hypothesized that increasing the pump diameter would increase the droplet diameter further, as the average energy dissipation for a pump is simply the power input to the fluid within the pump divided by the mass of fluid within the pump. The power transferred to the fluid within the pump is determined by the pressure drop within the pipeline system. The mass of fluid within the pump is determined by the volume of the pump. Using the relationship given in FIG. 4, a 34 inch pipeline using a pump having about twice the volume of a conventional pump that is used with a 30 inch pipeline (a typical conventional pump used in hydrotransport with 30 inch pipe has a fluid volume of around 1.4 $m^3$) would result in 270 micron droplets (as opposed to 222 micron droplets when using the conventional pump and 30 inch pipeline). This increase in droplet size would result in an approximately 50% increase in bitumen droplet rise velocity which would have a significant effect on overall bitumen recovery.

Figure 5:
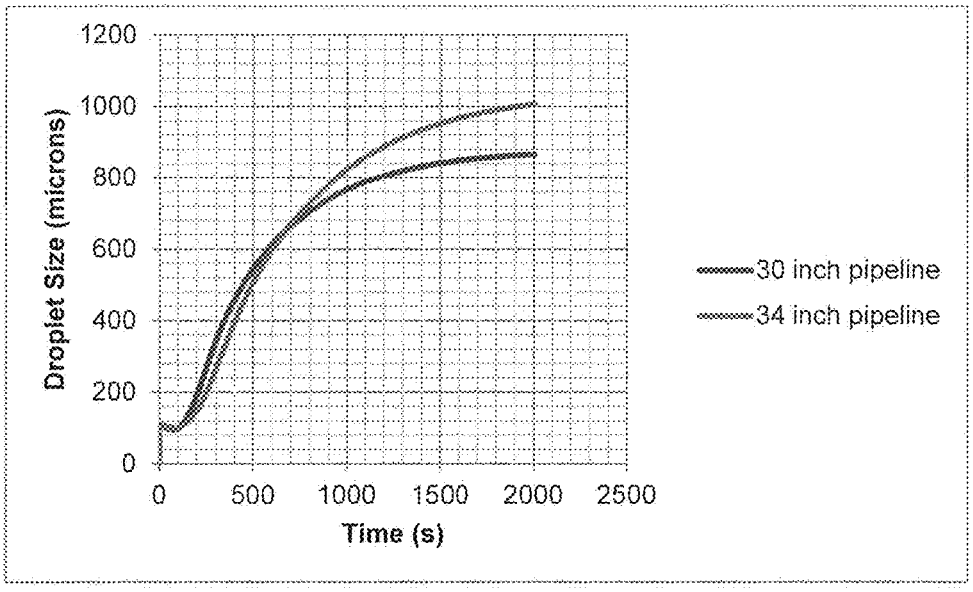
FIG. 5 is a graph showing aerated bitumen droplet size (in microns) when using a hydrotransport pipeline comprising 30 inch pipe and 34 inch pipe to condition oil sand slurry.

A model of conditioning, including the effects of lump ablation, bitumen liberation and bitumen coalescence/breakup, was used to validate the increase in bitumen droplet size predicted above. The model assumes that both lump ablation and bitumen coalescence/breakup are governed by the energy dissipation within the pipeline. The results of the model for both a 30 inch and a 34 inch pipeline are shown in FIG. 5. It can be seen from FIG. 5 that although the quantitative values obtained from the model are not in complete agreement with the quantitative values obtained above, the general trend of increased droplet diameter in a larger diameter pipeline is in agreement.

Figure 6:
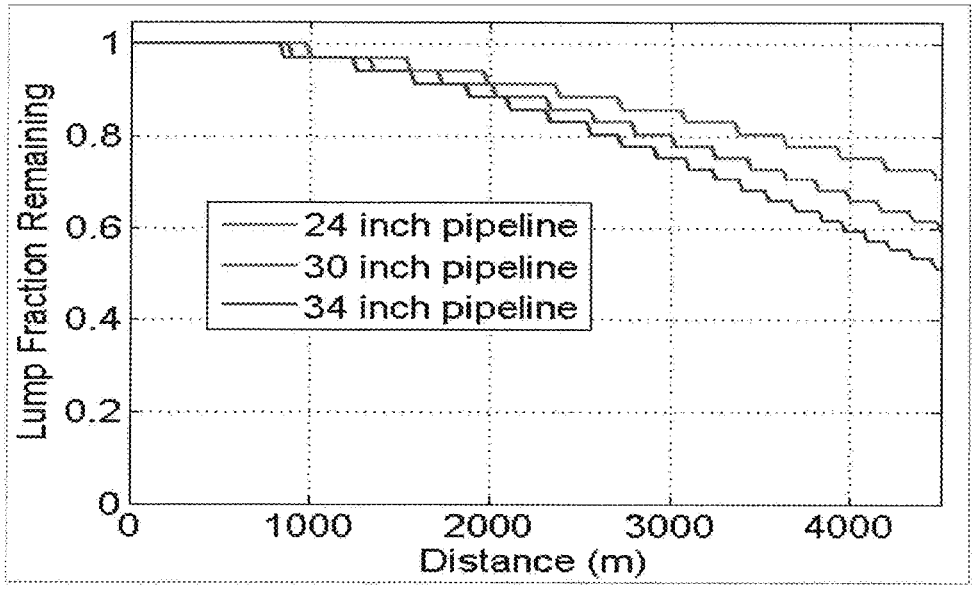
FIG. 6 is a graph showing lump ablation when using a 24 inch pipeline, a 30 inch pipeline and a 34 inch pipeline.

One of the concerns about operating a hydrotransport pipeline at reduced shear conditions is that these conditions would have a negative effect on lump ablation. A model for oil sand lump ablation was developed by the present applicant and validated against experimental lump ablation data and this model was used to estimate the effect of increased pipe diameter on this aspect of conditioning. It is important to note that the lump ablation model assumes that no ablation occurs within the pumps and is solely due to the thermal and mechanical energy in the pipeline. FIG. 6 summarizes the effect of pipe diameter on lump ablation at a given set of process conditions (flowrate, temperature, density, etc.).

It is clear from FIG. 6 that lump ablation improves as the pipe diameter increases. The model assumes that oil sand lumps are ablated by the outer skin of oil sand being heated up by the surrounding slurry and once the viscosity of this layer has been reduced adequately, the mechanical energy within the flow strips this layer of oil sand from the lump. This occurs repeatedly until the lump has been destroyed. The reduced velocity in a larger diameter pipe will lead to less mechanical energy within the slurry but longer residence times will lead to increased heat transfer to the lumps. The model results indicate that the increased heat transfer dominates and the lump ablation is improved as pipe diameter is increased.

It should be noted that the oil sand industry has reported the opposite trend, i.e., improved ablation in a smaller diameter pipeline (see Masliyah, J. H., Czarnecki, J., Xu, Z., "Handbook on Theory and Practice of Bitumen Recovery From Athabasca Oil Sands Volume I: Theoretical Basis", Kingsley Knowledge Publishing, 2011). However, Masliyah et al. assumed that the velocity remained constant between the two pipeline diameters and this led to increased mechanical energy in the smaller pipeline. In a commercial operation, however, it is the flow rate and not the velocity that would most likely be maintained, therefore, the results of Masliyah et al. are not applicable.

It should also be noted that the opposite trend with pipeline velocity has been proposed by the oil sand industry for both bitumen liberation and bitumen aeration, i.e., improved liberation and aeration with increased velocity, (see Sanders, S., Schaan, J., McKibben, M., "Oil Sand Slurry Conditioning Tests in a 100 mm Pipeline Loop", Can. J. Chem. Eng., 85 (2007) 756 and Qiu, L., "Effect of Oil Sands Slurry Conditioning on Bitumen Recovery from Oil Sands Ores", MSc. Thesis, University of Alberta, (2010) 55). Both of these studies are based on laboratory pipe loops operated by positive displacement pumps (Moyno pumps) and Wallwork et al. (Wallwork, V., Xu, Z., Masliyah, J., "Processability of Athabasca Oil Sand Using a Laboratory Hydrotransport Extraction System (LHES)", Can. J. Chem. Eng. 82 (2004) 689) note that such pumps impart very low shear to the material with velocities similar to those in the piping. A commercial centrifugal pump such as the TBC57.5 has velocities an order of magnitude higher than the pipeline; a system with a Moyno pump will not represent the shear in a centrifugal pump and will therefore not represent the correct behavior for either bitumen liberation or aeration in a commercial system. In addition to the effect of pump type in these studies, the laboratory pipe loops are also operated under relatively low pressure conditions (i.e. <300 kPa) while commercial systems are operated at significantly higher pressures (i.e. >1000 kPa); the higher pressure in a commercial system leads to smaller air bubbles regardless of shear rate, and these smaller bubbles will aerate bitumen droplets more effectively than the large bubbles generated in the laboratory studies (see, for example, Gu, G., Sanders, S., Nandakumar, K., Xu, Z., Masliyah, J., "A Novel Experimental Technique to Study Single Bubble-Bitumen Attachment in Flotation", Int. J. Miner, Process 74 (2004) 21).

It was further discovered that the use of the larger diameter pump and pipelines (i.e., a reduced shear system) not only improved the reliability of slurry systems, enhanced bitumen conditioning and improved overall bitumen recovery, but also reduced water-in-oil (water-in-bitumen) emulsions. Reduced water-in-bitumen emulsions result in better bitumen froth and diluted bitumen product quality. Water-in-bitumen emulsions are formed prior to froth formation, i.e. they are most likely to be originated from the pumps and pipelines slurry system. Thus, the use of larger diameter pumps and larger diameter pipe with result in reduced shear condition and, hence, less dispersed water will be formed.

Without being bound to theory, it is believed that the formation of water-in-bitumen emulsions may be due to:

1. Shear induced emulsification: Shear-induced emulsification or drop fracture of water droplets can occur within the oil due to the high shearing environment, followed by satellite drop formation, which can be two orders of magnitude smaller than their parent drop. A high shear environment not only produces dispersed water from free water, it also breaks down the large droplets into smaller droplets as a result of drop fracture due to shear force. This is more likely occurring within the pump, due to the high shear rates involved in the pump, than in the downstream regions after phase separation occurs at a lower shear environment.

2. Tip-streaming: Tip streaming is a mechanism that could create small water droplets, but this mechanism will happen only if larger water droplets are trapped within the oil. Because the viscosity contrast is high, there is likelihood of emulsification from such trapped water. This phenomenon could happen within the pump (in its lower shear regions) or downstream of the pump.

3. Emulsification by particles penetration from water into oil: Fluid fluctuation motion induced by turbulence (a small scale eddy) could drive a particle from the water phase across the water-oil interface (which has a low interfacial tension as a result of caustic addition). This particle could drag a thread of water that could breakup into little droplets forming water in bitumen emulsion. A reduced shear slurry system will reduce the potential of the above emulsion formation processes, hence resulting in lower water-in-bitumen emulsion in froth, better froth processability in froth treatment plant and enhanced diluted bitumen product quality.

A Batch Extraction Unit (BEU) was used to determine the effect shear imparted into oil sand slurry had on the formation of water-in-oil emulsions in bitumen froth. The amount of shear imparted into oil sand slurry was varied by adjusting the rotational speed of the impeller. Micrograph were then taken on froth samples from BEU runs with impeller speeds of 300, 600 and 900 rpm. FIGS. 7A, 7B and 7C are micrographs showing water droplet sizes formed at 300 rpm, 600 rpm and 900 rpm, respectively. The maximum diameter of the emulsified water droplets in froth samples were 23 μm, 15 μm and 7 μm when impeller speeds were 300 rpm, 600 rpm and 900 rpm, respectively. Thus, at higher shear rates, water droplet size decreased significantly.

EXAMPLE 2

In this example, the effect of pumping (i.e., high shear) on bitumen froth free water was examined to determine whether reduced shearing could be used to reduce water-in-bitumen emulsions (also referred to herein as dispersed water). As previously mentioned, bitumen froth produced during bitumen extraction is further treated in a froth treatment plant. Generally, the bitumen froth is first deaerated in a deaeration unit known in the art prior to being pumped to the froth treatment plant. The froth treatment plant used in the following experiments is a naphtha froth treatment plant comprising at least one inclined plate settler (IPS) and at least one centrifuge.

Once bitumen froth has been deaerated, the bitumen froth is pumped (generally by means of centrifugal pumps) to the at least one IPS where naphtha diluent is added and the bitumen froth is subjected to gravity settling in the IPS to remove a portion of the water and solids. The diluted bitumen froth from the IPS is then pumped (generally by means of centrifugal pumps) to the centrifuge where additional solids and water are removed to form a diluted bitumen product. Samples of the bitumen froth were taken at the suction and discharge sides of the pump which pumps the bitumen froth to the IPS(s) and samples were taken of the diluted bitumen froth on the suction and discharge sides of the pump which pumps the diluted bitumen froth to the centrifuge(s). The samples were analyzed for bitumen content, total water and dispersed water (water-in-bitumen emulsions). The results are shown in Table 2.

TABLE 2

| Froth Composition, wt % | | | | | | |
|---|---|---|---|---|---|---|
| Pump ID | Time | Location | Bitumen | Total Water | Dispersed Water | Solids |
| IPS Feed | 8:40 | Suction | 53.4 | 35.7 | 11.2 | 10.9 |
| | | Discharge | 53.7 | 35.6 | 17.6 | 10.7 |
| | 13.15 | Suction | 59.4 | 31.4 | 9.3 | 9.2 |
| | | Discharge | 60.0 | 30.8 | 11.7 | 9.2 |
| | 14:05 | Suction | 58.7 | 31.8 | 9.1 | 9.5 |
| | | Discharge | 59.9 | 31.0 | 14.1 | 9.2 |
| Centrifuge Feed | 15:10 | Suction | 58.7 | 31.2 | 8.2 | 10.0 |
| | | Discharge | 58.5 | 31.5 | 10.3 | 10.1 |

The froth pumps used in this example were single stage Ingersoll-Dresser centrifugal pumps (Model No. 10H345).

It can be seen from Table 2 that the composition of the froth and diluted froth in terms of bitumen, total water and solids content were the same before and after the feed pumps. However, the froth and diluted froth dispersed water was significantly higher at the discharge side of the pumps than the suction side of the pumps. An average of 41% increase in froth dispersed water was observed in the four sets of froth samples.

Table 2 clearly shows that a significant amount of froth dispersed water was formed after the pump as a result of the shearing effect in centrifugal pumps. Microscopy work indicated that pumping effect increased the froth dispersed water of all droplet size range.

EXAMPLE 3

As discussed in Example 1, it was discovered that the use of a high energy input slurry preparation unit such as a jet pump (ε=5000 W/kg) versus a low energy input slurry preparation unit such as a tumbler (ε=5 W/kg) resulted in very small bitumen droplet size (150 μm versus 650 μm, respectively) in the resultant slurry and, hence, small bitumen-air aggregates.

In this example, bitumen was extracted from three different oil sand ore samples, each ore having different bitumen and fines concentrations, using a tumbler and a jet pump to produce slurry. Table 3 shows the extraction performance (i.e., overall bitumen recovery) using these three different ores when using low energy extraction (tumbler) versus high energy extraction (jet pump).

TABLE 3

| Oil Sand Sample | Overall Bitumen Recovery - Tumbler | Overall Bitumen Recovery Jet Pump |
|---|---|---|
| Sample 1 (10% bitumen; 27% fines (<44 μm); $d_{50}$ 122 μm) | 66.68% | 30.49% |
| Sample 2 (13.8% bitumen; 10% fines (<44 μm); $d_{50}$ 154 μm) | 87.85% | 37.55% |
| Sample 3 (9.1% bitumen; 16% fines (<44 μm); $d_{50}$ 162 μm) | 75.80% | 55.02% |

It can be seen from Table 3 that the overall bitumen recovery using a tumbler ranged from about 67% to 88%, where with the jet pump ranged from about 30% to 55%. The lower bitumen recovery achieved with the jet pump is likely attributable to the formation of small bitumen-air aggregates/droplets as a result of high shear generated by the jet pump. The bitumen recovery from the tumbler slurry was significantly higher than that from the jet pump slurry in all instances.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

We claim:

1. A process for conditioning an oil sand slurry, comprising:

determining an energy dissipation rate necessary for obtaining a desired bitumen droplet size;

designing a hydrotransport pipeline comprising pipe and at least one slurry pump by determining a diameter of pipe and/or a volume of the at least one slurry pump necessary to achieve the energy dissipation rate;

conditioning the oil sand slurry in the so designed hydrotransport pipeline; and introducing the conditioned oil sand slurry into a primary separation vessel wherein separate layers of primary bitumen froth, middlings and sand tailings are formed.

2. The process as set forth in claim 1, further comprising treating the primary bitumen froth with a diluent to produce a diluted bitumen product having reduced solids and/or reduced water.

3. The process as set forth in claim 2, wherein the diluent is naphtha.

4. The process as set forth in claim 3, wherein the naphtha diluted bitumen froth is pumped to an inclined plate settler or a scroll centrifuge for removal of solids and water from the naphtha diluted bitumen froth.

5. The process as set forth in claim 4, wherein the solids and water reduced naphtha diluted bitumen froth is further pumped to a disc centrifuge where further solids and water are removed to form the diluted bitumen product.

* * * * *